US007223011B2

(12) United States Patent
Wright

(10) Patent No.: US 7,223,011 B2
(45) Date of Patent: May 29, 2007

(54) DEVICE FOR REMOVING AND INSTALLING FLUORESCENT LIGHTS

(76) Inventor: Otis Wright, 1936 Snapfinger Rd., Decatur, GA (US) 30322

( * ) Notice: Subject to any disclaimer, the term of this patent is extended or adjusted under 35 U.S.C. 154(b) by 131 days.

(21) Appl. No.: 10/994,937

(22) Filed: Nov. 22, 2004

(65) Prior Publication Data

US 2006/0107795 A1 May 25, 2006

(51) Int. Cl.
*H01R 33/00* (2006.01)
*A47F 13/06* (2006.01)

(52) U.S. Cl. ..... 362/647; 362/656; 362/652; 81/53.12; 294/19.1

(58) Field of Classification Search ..... 362/647, 362/652, 656; 294/19.1, 99.2; 81/53.11, 81/53.12

See application file for complete search history.

(56) References Cited

U.S. PATENT DOCUMENTS 4,719,826 A 1/1988 DuBois
5,379,666 A * 1/1995 Held ..... 81/53.1
5,730,033 A 3/1998 Mitrowski
5,746,615 A * 5/1998 Ichikawa et al. ..... 439/227
5,809,850 A * 9/1998 Tickner ..... 81/53.11
6,257,095 B1 7/2001 Yukness
6,340,310 B2 * 1/2002 Henrici et al. ..... 439/346
2004/0206210 A1 * 10/2004 Tryba ..... 81/53.1

FOREIGN PATENT DOCUMENTS

JP 01197961 9/1989

* cited by examiner

*Primary Examiner*—Renee Luebke
*Assistant Examiner*—Evan Dzierzynski
(74) *Attorney, Agent, or Firm*—Kilpatrick Stockton LLP

(57) ABSTRACT

The present invention is directed to a device for changing a fluorescent light, in particular a compact fluorescent light. Generally, the device comprises a light bulb receiving portion with a receptacle sufficient in size to accommodate a compact fluorescent light. The device further comprises a latching mechanism for engaging the bulb portion of a compact fluorescent light bulb, whereby the latching mechanism is located on the light bulb receiving portion and facilitates removal of a compact fluorescent light. By properly orientating the device around a compact fluorescent light, one can also use the device to install a compact fluorescent light.

20 Claims, 3 Drawing Sheets

DEVICE FOR REMOVING AND INSTALLING FLUORESCENT LIGHTS

FIELD OF THE INVENTION

The invention relates generally to a device for removing and installing light bulbs, and more specifically, to a device for removing and installing compact fluorescent lights.

BACKGROUND

Over the past several years, advances in light bulb technology have allowed light bulb manufacturers to design light bulbs in a variety of shapes and sizes. In particular, much advancement has come in the area of fluorescent lighting. Although the long, cylindrical fluorescent bulb design is still commonplace in many office and other buildings, newer and more compact fluorescent bulbs are becoming increasingly prevalent. One reason for the prevalence is that these new bulbs take advantage of folded-tube technology. This technology permits the manufacture of small, compact fluorescent bulbs that one can easily insert into a variety of decorative and practical fixtures. And since fluorescent bulbs have much longer lifespans than traditional incandescent light bulbs, these compact fluorescent bulbs offer a more energy-efficient alternative than traditional incandescent bulbs.

Despite their increased lifespan and practicality, the newer generation of fluorescent bulbs eventually bum out and need changing. As with traditional incandescent bulbs, changing these compact fluorescent bulbs unfortunately remains very inconvenient. Many environments that use these bulbs have relatively high ceilings and light fixtures. Since most fluorescent light bulbs are placed in high, hard-to-reach places, such as the ceiling, one must first gain access to the bulb. This may require the use of a ladder. In private homes, recessed light fixtures that contain compact fluorescent bulbs may be placed on high, vaulted ceilings that many standard home ladders cannot reach. In many businesses, compact fluorescent lighting is the primary source of artificial lighting. For instance, a single building of a medium size office complex may contain several hundred compact fluorescent lights. With such a large number of lights, employees may be required to change burned out lights on a daily basis. And because of the unavailability of a convenient compact fluorescent light changer, these employees must carry their ladders, sometimes over long distances, to change burned out bulbs.

The lack of compact fluorescent light changers also poses substantial safety risks. As noted above, changing these lights usually requires one to use a ladder or scaffolding to access the light, an undertaking that is inherently dangerous. Additionally, manually changing a light bulb usually requires one to grasp the glass of the bulb and either unscrew or pull the bulb's base from the light bulb socket. If one applies too much force, the bulb's glass may break and cause lacerations to the hand. Also, because one usually looks upwards at a bulb while changing it, glass can fall into the face and eyes if a bulb breaks.

Even though various light bulb changers exist for globe-type incandescent light bulbs, similar devices that work on compact fluorescent lights appear to be virtually unavailable. Additionally, existing changers do not overcome the problems described above. For example, some existing light bulb changers use an unsafe gripping means to remove or install light bulbs. With other existing light bulb changers, one must manually close a clasping means that applies imprecise and continuous pressure to the light bulb glass, risking breakage of the glass. Other existing light bulb changers use a twisting means to install or remove light bulbs. Similar to the gripping-type devices, the resulting torque from this twisting motion can cause the glass bulb to break and fall from dangerously high places.

Existing light bulb changers use complex means for installing or removing light bulbs. For example, some light bulb changers depend on multi-component light bulb receiving portions that one must manually reconfigure for installation and removal of a bulb. Other light bulb changers rely on strings or chains to close gripping or clasping means, whereas other light bulb changers use multiple, spring-type grippers or motorized clasps for gripping light bulbs. Despite this complexity in design, some existing light bulb changers do not provide the duel function of both removing and installing a light bulb; rather, these changers only permit one to remove a bulb.

Because of the lack of available fluorescent light bulb changers, a need exists for a device that can install and remove compact fluorescent lights. Also, because of the inconvenience associated with changing light bulbs, a need exists for a simple light bulb changer that is transportable over large distances. A need also exists for a simple light bulb changer that is practical for use in the home, office, or other buildings. Finally, a need exists for a light bulb changer that does not rely on dangerous twisting or clasping means to remove or install a light bulb.

SUMMARY

The present invention is an apparatus for the installation and removal of a compact fluorescent light. Although other light bulb changers exist, certain embodiments of the present invention provide a light bulb changer specifically directed towards the installation and removal of compact fluorescent light bulbs. Generally, the device according to certain embodiments comprises a housing element sufficient in size to accommodate various sizes of compact fluorescent light bulbs and a latching mechanism preferably located on the housing element. Because one may attach a pole to the device to access bulbs in high, hard to reach places, the device of the present invention is also convenient to use, allowing one to access and change a compact fluorescent light without the need for using or transporting a ladder, scaffolding, or other supporting device. In use, one simply passes the housing element according to certain embodiments over the glass portion of a compact fluorescent light bulb until the latching mechanism engages. After the latching mechanism engages the bulb, one can safely remove the bulb by pulling the device in a gentle downward motion. To install a fluorescent bulb, one simply places the bulb in the device in an orientation that does not allow the latch to engage. The latch is preferable positioned between the two fluorescent tubes. One can then hoist the light bulb into its socket.

The present invention is advantageous because it allows one to both remove and install compact fluorescent lights in a safe manner.

In particular, the user of the present device does not need to climb a ladder or scaffolding. Also, because the device according to certain embodiments of the present invention comprises a housing element that surrounds a compact fluorescent light bulb during installation and removal, any broken glass that might result will remain within the device's housing and thus not fall unpredictably from the bulb's overhead mounting, endangering the user.

DETAILED DESCRIPTION

Figure 1:
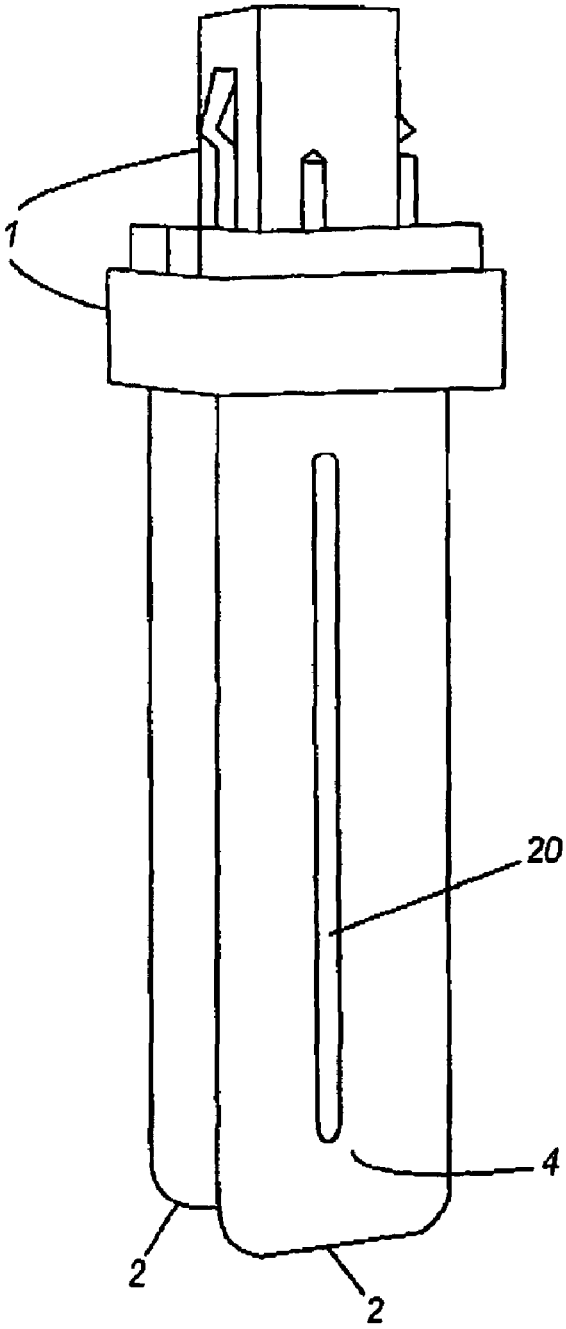
FIG. 1 is a perspective view of a compact fluorescent light.
Figure 2:
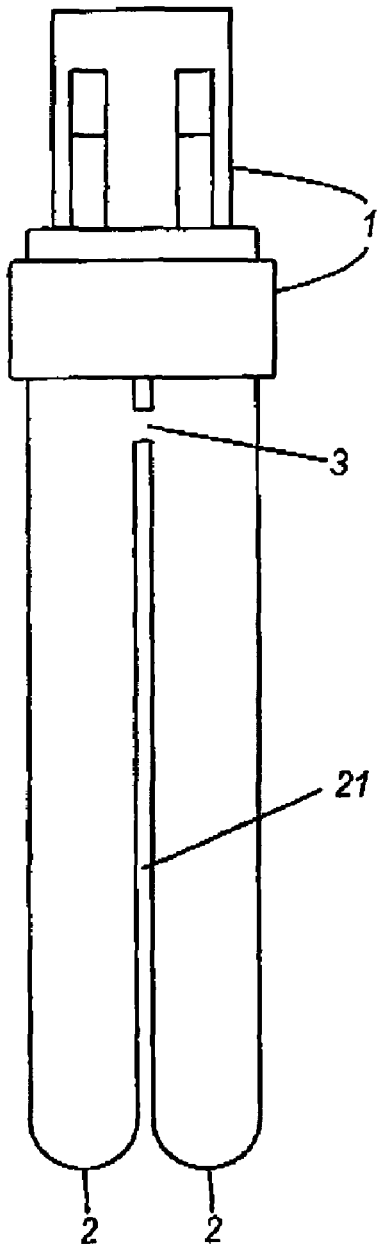
FIG. 2 is a side-view of FIG. 1, turned approximately 45 degrees.

As noted above, advances in light bulb technology have permitted the construction of compact fluorescent light bulbs in many different shapes and sizes. To conserve space and to maintain increased light output, manufacturers of compact fluorescent bulbs typically mount a series of U-shaped fluorescent light tubes in a configuration running parallel to a common long axis. Referring to FIG. 1, at one end of this axis is the bulb's base (or "cap") [1], which mounts to a ceiling fixture or socket. At the other end of the axis is the bulb's apex [2], which generally hangs downward towards the floor. Each U-shaped tube, or "twin-tube" as it is known in the art, represents a single tube and contains an empty center region [20]. Thus, for example, a double twin-tube configuration would consist of two U-shaped tubes configured side-by-side and mounted into a square-type base; a triple twin-tube configuration would consist of three U-shaped tubes configured on alternating sides of a hexagonally-shaped base. Referring to FIG. 2, between each adjacent U-tube is a gap [21]. Near the base region, each twin-tube typically contains a neck region [3] that connects a twin-tube to the other twin-tubes in the series. Referring to FIG. 1, the apex [2] of each twin-tube, which is not connected to the other tubes in the series, forms the U-shaped region [4] for each twin-tube. The present invention takes advantage of this prevalent U-shaped, twin-tube design, allowing one to safely and conveniently remove or install compact fluorescent lights with different twin-tube configurations.

Figure 3:
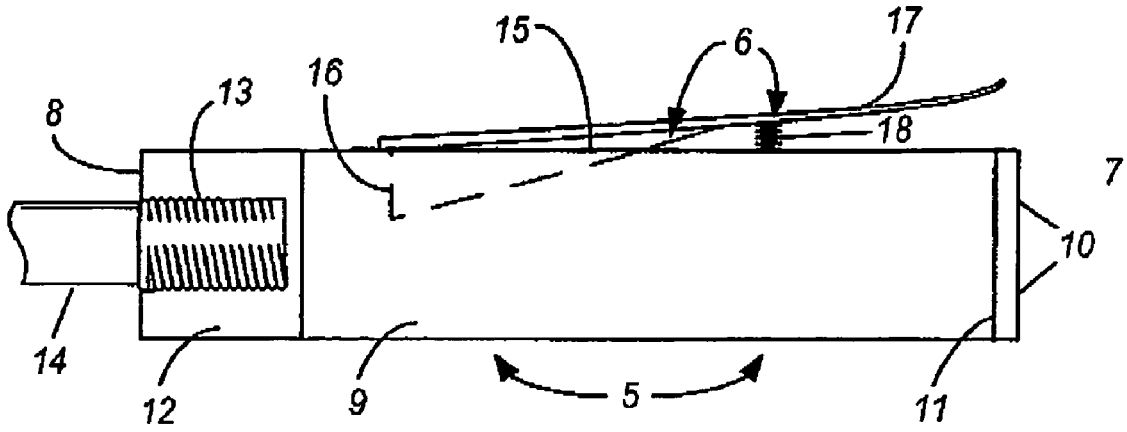
FIG. 3 is an exploding side view of a light bulb changing device.
Figure 4:
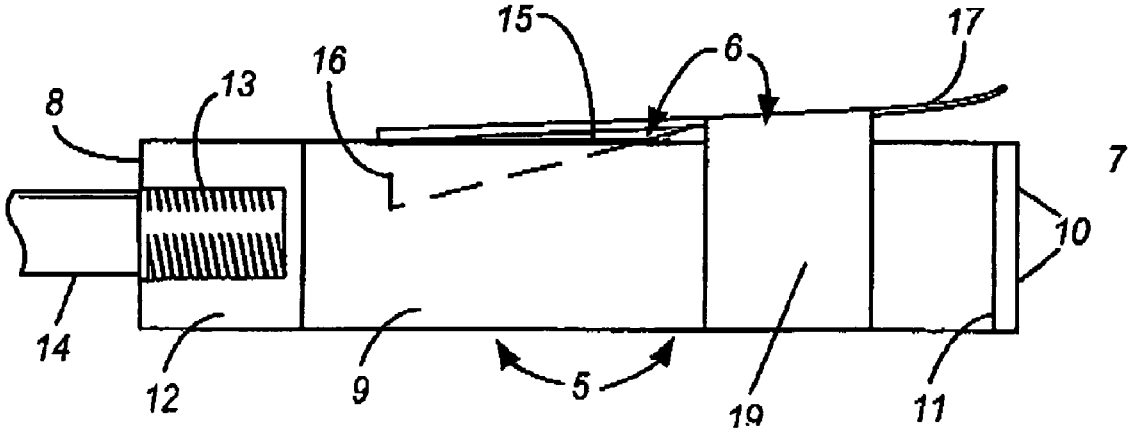
FIG. 4 is an exploding side view of a light bulb changing device.

Referring to FIG. 3 and FIG. 4 in its broad context, certain embodiments of the present invention provide a device for changing a compact fluorescent light comprising a light bulb receiving portion [5] and a latching mechanism [6]. The light bulb receiving portion consists of a top end [7] and a base [8]. Also, the light bulb receiving portion of the present invention has a hollow, multi-faced or cylindrical housing element [9] that can in some embodiments comprise a single body. For multi-faced housings, each face is usually rectangular, but may also be square or a variety of other shapes. Although one may use a variety of different materials to construct the housing, a sturdy plastic or a light weight metal such as aluminum is preferred.

Figure 5:
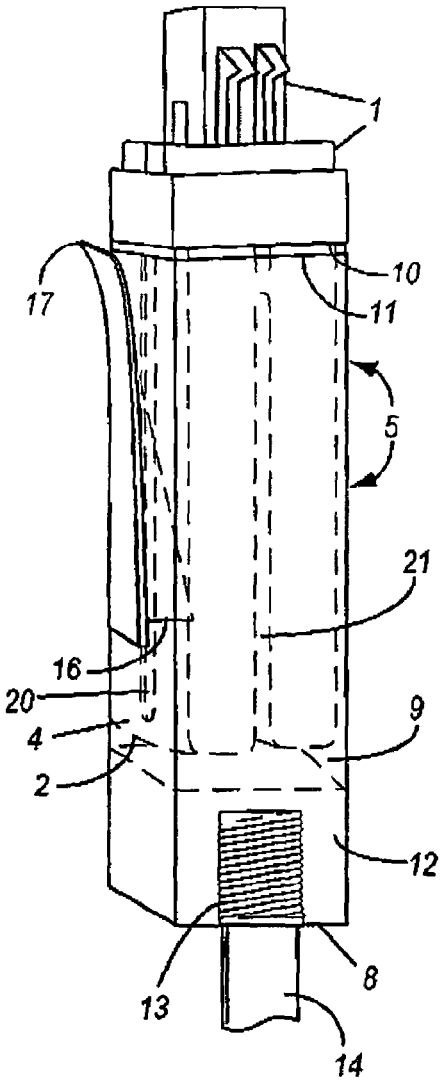
FIG. 5 is a perspective view of a light bulb changing device containing a compact fluorescent light orientated for removal.
Figure 6:
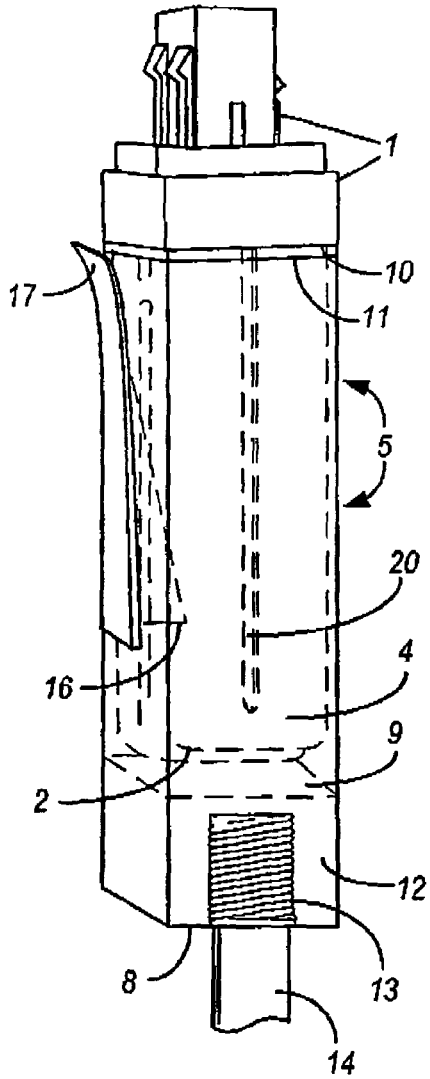
FIG. 6 is a is a perspective view of a light bulb changing device containing a compact fluorescent light oriented for installation.

As FIG. 5 and FIG. 6 show, according to embodiments of the invention the top end of the housing contains a receptacle sufficient in size to accommodate the glass bulb portion or portions of a compact fluorescent light. During either installation or removal of a bulb, one passes the device housing over the glass portion of the bulb until the bulb's base [1] portion closest to the glass of the bulb rests on the orifice [10] of the housing's receptacle or on a lip region [11] associated with the housing's receptacle. To prevent the bulb's base from sliding into the housing during bulb installation or removal, the orifice [10] of the housing's receptacle or the lip region [11] is slightly smaller than the base [1] of the bulb that is to be inserted. In this way, the receptacle's orifice or lip region provides a platform upon which the bulb's base rests. For example, a bulb base [1] that is square with rounded edges may measure 34 mm by 34 mm in the square portion. To accommodate a bulb base with these dimensions, the receptacle's orifice [10] or lip region [11] would be, for example, slightly less than 34 mm by 34 mm at the square portion but large enough to allow the glass bulb tubes to pass within the hollow chamber of the housing. Certain embodiments of the present invention contemplate a housing receptacle whose orifice or lip region can accommodate a variety of bulb base shapes and sizes in the manner described above, including but not limited to base shapes and sizes associated with bulbs known by those skilled in the art as single twin-tube bulbs, double twin-tube bulbs, and triple twin-tube bulbs. The housing's receptacle can also accommodate bulb bases known in the art by the following base designations: G23-2, GX23-2, G24D-1, G24D-2, G24D-3, G24Q-1, G24Q-2, G24Q-3, GX24D-1, GX24D-2, GX24D-3, GX24Q-1, GX24Q-2, GX24Q-3, GX24Q-4, 2G7, 2G11, 2GX7, G23 and GX23. Although the housing receptacle of a particular device accommodates at least one bulb base shape and at least one bulb base size, in many cases the housing receptacle of a single device may accommodate a plurality of different bulb base shapes and sizes.

The housing element [9] according to certain embodiments of the present invention is long enough to accommodate compact fluorescent bulbs with varying bulb lengths. The housing [9] may preferably be approximately 20 cm long from top to base. But depending on the type of bulb, the length of the housing element from top to base may range from about 80 cm to about 5 cm in length. For example, to accommodate single twin-tube bulbs, the housing element may range from about 76 cm to about 12 cm in length. Alternatively, to accommodate single twin-tubes, the housing element may range from approximately 70 cm to about 17 cm in length. Alternatively, to accommodate single twin-tube bulbs, the housing may range from about 60 cm to about 22 cm in length. To accommodate a double twin-tube bulb, the length of the housing element may range from about 25 cm to about 19 cm. Alternatively, to accommodate a double twin-tube bulb, the housing element may range from approximately 21 cm to about 15 cm in length. Alternatively, to accommodate a double twin-tube bulb, the housing element may range from about 17 cm to roughly 10 cm in length. To accommodate a triple twin-tube bulb, the length of the housing element may range from about 21 cm to roughly 17 cm. Alternatively, to accommodate a triple twin-tube bulb, the housing element may range from 18 cm to 13 cm in length. Alternatively, to accommodate a triple twin-tube bulb, the housing element may range from 15 cm to 9 cm in length. It should be understood that one may construct the housing element so that it is long enough to accommodate any fluorescent bulb known in the art with the following base designation: G23-2, GX23-2, G24D-1, G24D-2, G24D-3, G24Q-1, G24Q-2, G24Q-3, GX24D-2, GX24D-3, GX24Q-1, GX24Q-2, GX24Q-3, GX24Q-4, 2G7, 2G11, 2GX7, G23 and GX23.

The base of the housing element [8] contains a solid plug [12] of sturdy plastic, metal, wood or other lightweight material. This plug [12] may be an individual element of the present invention or one may machine or manufacture this plug as a part of the housing element [9] itself. In either case, this plug [12] contains a threaded hole [13] suitable for the insertion of an adjustable-length rod or pole [14].

To engage and remove a compact fluorescent light bulb, embodiments of the present invention utilize a latching mechanism. Referring to FIG. 3 and FIG. 4, this latching mechanism [6] comprises a slot [15] running along the housing element [9], a latching element [16], and a small spring-loaded lever element [18] in some embodiments. Specifically, one of the faces of a multi-faced housing element preferably contains a narrow slot [15] running parallel to the long axis of the device. In the example embodiment shown in FIG. 3 and FIG. 4, this slot [15] is approximately 5 cm in length and roughly 3 mm wide. Projecting though this slot [15] and running perpendicular to the surface of the housing element [9] is a latching element [16]. One may construct the latching element out of the same or a different material as the housing element, and one may additionally coat the latching element with a soft material such as rubber or plastic to prevent scratching of the bulb's tubes. The latching element [16] is preferably broadest towards the base [8] of the light bulb receiving portion but progressively tapers towards the top end [7] of the receiving portion so that only some of the latching element [16] actually extends though the housing element near the top [7] of the device. Alternatively, the latching element is broadest near the base of the housing unit and rounded near the top end of the housing element. According to certain embodiments, the shape of the latching element closest to the top of the receiving portion should facilitate easy passage of the latching element [16] over a bulb's glass surface.

Associated with the latching element [16] is a lever element [17]. This lever element may [17] comprise a flat piece of sturdy plastic or lightweight material that runs perpendicular to the latching element [16]. Alternatively, the lever element [17] and latching element [16] may comprise a single piece of material. Near the base [8] end of the light bulb receiving portion the lever element [17] runs flush with the outer surface of the housing element [9]. But moving towards the top [7] of the device, the lever element [17] progressively projects away from the surface of the housing element [9]. As FIG. 3 illustrates, a spring-type element [18] is located near the fulcrum of the lever element [17]. Referring FIG. 4, one may, alternatively, place a resilient material [19] over the outer surface of the lever element [17]. lever element [17].

To remove a compact fluorescent light according to embodiments of the present invention, one must properly orient the light bulb receiving portion and then slip the housing element receptacle over the bulb portion of a compact fluorescent light. In the proper orientation for light bulb removal as illustrated in FIG. 5, the latching element [16] passes over the apex [2] of a bulb U-tube and fits into the center region [20] of the U-tube. The shape of the latching element [16] permits the latching element to slide over the apex [2] of the U-tube and into the center region [20] of the U-tube. Once the latching element [16] is within the center region [20] of the bulb U-tube, the spring [18] or resilient [19] element according to certain embodiments coupled with the broad shape of the latching element near the base of the receiving portion prevents the latching element [16] from slipping back over the U-shaped portion [4] of the apex [2]. Thus, one can easily remove a compact fluorescent light from its mounting socket by pulling the light bulb changing device in a downward motion. The latching mechanism [16] engages within the center region [20] of the U-tube, allowing one to pull the bulb's base [1] out of the light socket. By simply depressing the lever element [17] of the latching mechanism [6], one can disengage the latching mechanism and slip the spent light bulb out of the device.

To install a compact fluorescent light, the light bulb changing device relies on the configuration of the U-tubes on a given bulb. For example, on a double twin-tube bulb, two U-tubes exist that are located side by side. The space between these two tubes is commonly empty creating a gap [21]. Referring to FIG. 6, to install a bulb, one first orients the bulb in the light bulb receiving portion so that the latching element [16] lies in the gap [21] between the two U-tubes. In the proper orientation, the bulb is free to move in and out of the light bulb receiving portion since the latching mechanism [16] cannot engage the bulb's U-tube. The bulb remains in the housing due to gravitational forces. One can then install the light bulb by hoisting the bulb upward and pushing its base [1] into a mounting socket.

According to certain embodiments of the present invention, one affixes the light bulb changing device to a rod or pole [14]. The rod or pole [14] may be of a fixed length or adjustable length. Those of skill in the art will understand that a variety of rods or poles may be used in combination with the light bulb receiving portion. As noted above, the light bulb receiving portion preferably contains a threaded hole [13] in the plug [12] portion of its base. By connecting a fixed or adjustable-length rod or pole into this threaded region, one can access compact fluorescent bulbs located at different elevations.

Also according to certain embodiments of the present invention, the base [8] of the receiving portion is contiguous with an external coupler element. The coupler element is threaded, permitting one to attach a rod or pole to the light bulb receiving portion. Additionally, one may fit the coupler with a locking screw to secure the pole in place. Those skilled in the art will appreciate that one may use a variety of couplers and coupler arrangements to attach a rod or pole to the light bulb receiving portion.

In another embodiment of the present invention, one attaches a light bulb changing device to both ends of a fixed or adjustable-length rod or pole. For example, on one end, the light bulb changing device may accommodate double twin-tube bulbs, whereas on the other end the light bulb changing device may accommodate triple twin-tube bulbs.

According to certain embodiments, the present invention provides a device for changing single twin-tube fluorescent lights. These single twin-tube bulbs include but are not limited to bulbs with the following base designations: 2G7, 2G11, 2GX7, G23 and GX23. Unlike the series configuration of U-tubes running as described above, the single twin-tube bulb consists of one U-tube connected to a base. Because of this design, positioning the single twin-tube bulb within the housing element in a manner that avoids engagement of the latching element is not possible. To circumvent this problem, one attaches two light bulb changing devices to the ends of a rod or pole as described above, but in this embodiment, one of the devices does not contain a latching mechanism. Thus, one uses the end with the latching mechanism to remove a bulb, and the end without a latching mechanism to install a light bulb.

According to certain embodiments, the light bulb changing device utilizes additional latching mechanisms. For example, to remove a double twin-tube bulb, the housing element may contain two latching mechanisms on directly opposite faces. With this arrangement, a latching mechanism would engage both of the twin-tubes. In another example, two or three latching mechanisms may engage multiple twin-tubes on a triple twin-tube compact fluorescent bulb. Although not necessary for the function of the present invention, arrangements such as these may provide increased stabilization of the light bulb receiving portion around the bulb.

According to certain embodiments, the present invention comprises a kit for changing a compact fluorescent light. This kit may include, for example, a light bulb changing device and a fixed or adjustable length rod or pole. This kit may also contain light bulb changing devices that fit different compact fluorescent bulb sizes or different compact fluorescent bulb shapes. The kit may also contain instructions for use of the kit components and light bulbs of varying sizes.

I claim:

1. A device for changing a compact fluorescent light, comprising:

(a) a light bulb receiving portion comprising a receptacle orifice sufficient in size to accommodate a compact fluorescent light, and (b) a latching mechanism for engaging a U-shaped bulb portion of a compact fluorescent light bulb, whereby the latching mechanism is located on the light bulb receiving portion and facilitates removal of a compact fluorescent light.

2. The device of claim 1, wherein the latching mechanism engages the U-shaped bulb portion of a compact fluorescent U-tube when removing a compact fluorescent light from a light socket.

3. The device of claim 1, wherein the latching mechanism is oriented along the gap between sections of the U-shaped portion of a compact fluorescent light when installing a compact fluorescent light.

4. The device of claim 1, wherein the latching mechanism comprises a lever element that facilitates removal of a compact fluorescent light from the light bulb receiving portion when the lever element is depressed.

5. The device of claim 1, wherein the receptacle orifice is sufficient in size to accommodate compact fluorescent lights comprising base designations: G23-2, GX23-2, G24D-1, G24D-2, G24D-3, G24Q-1, G24Q-2, G24Q-3, GX24D-2, GX24D-3, GX24Q-1, GX24Q-2, GX24Q-3, GX24Q-4, 2G7, 2G11, 2GX7, G23, GX23, 2G7, 2G11, 2GX7, G23 or GX23.

6. The device of claim 1, wherein the receptacle orifice serves as a platform for the base of a compact fluorescent light during installation and removal of the compact fluorescent light.

7. The device of claim 1, wherein the light bulb receiving portion further comprises a lip region located near the receptacle orifice that is sufficient in size to accommodate the bulb portion of a compact fluorescent light and that serves as a platform for the base of a compact fluorescent light during installation and removal of a compact fluorescent light.

8. A device for changing a compact fluorescent light, comprising:

(a) a light bulb receiving portion comprising a receptacle orifice sufficient in size to accommodate a compact fluorescent light, and (b) a latching mechanism for engaging the U-shaped portion of a compact fluorescent U-tube, whereby the latching mechanism is located on the light bulb receiving portion and facilitates removal of a compact fluorescent light.

9. The device of claim 8, wherein the latching mechanism comprises a latching element positioned within the center region of a compact fluorescent U-tube when removing a compact fluorescent light.

10. The device of claim 8, wherein the latching mechanism comprises a latching element positioned within the gap between the bulbs of a compact fluorescent light when installing a compact fluorescent light.

11. The device of claim 8, wherein the latching mechanism comprises a lever element that facilitates removal of a compact fluorescent light from the light bulb receiving portion when the lever element is depressed.

12. The device of claim 8, wherein the receptacle orifice is sufficient in size to accommodate compact fluorescent lights comprising base designations: G23-2, GX23-2, G24D-1, G24D-2, G24D-3, G24Q-1, G24Q-2, G24Q-3, GX24D-2, GX24D-3, GX24Q-1, GX24Q-2, GX24Q-3, GX24Q-4, 2G7, 2G11, 2GX7, G23, GX23, 2G7, 2G11, 2GX7, G23 or GX23.

13. The device of claim 8, wherein the receptacle orifice serves as a platform for the base of a compact fluorescent light during installation and removal of the compact fluorescent light.

14. The device of claim 8, wherein the light bulb receiving portion further comprises a lip region located near the receptacle orifice that is sufficient in size to accommodate the bulb portion of a compact fluorescent light and that serves as a platform for the base of a compact fluorescent light during installation and removal of a compact fluorescent light.

15. A device for changing a compact fluorescent bulb, comprising:

(a) a light bulb receiving portion comprising a receptacle orifice sufficient in size to accommodate a compact fluorescent light, and (b) a means for engaging the U-shaped portion of a compact fluorescent U-tube, whereby the means for engaging the U-shaped portion of a compact fluorescent U-tube are located within the light bulb receiving portion and facilitate removal of a compact fluorescent light.

16. The device of claim 15, wherein the means for engaging the U-shaped portion of a compact fluorescent U-tube comprises a latching element.

17. The device of claim 16, wherein the latching element is positioned within the center region of a compact fluorescent U-tube when removing a compact fluorescent light.

18. The device of claim 16, wherein the latching element is positioned within the gap between the bulbs of a compact fluorescent light when installing a compact fluorescent light.

19. The device of claim 16, wherein the means for engaging the U-shaped portion of a compact fluorescent U-tube further comprises a lever element that facilitates removal of the compact fluorescent light from the light bulb receiving portion when the lever element is depressed.

20. The device of claim 15, wherein the light bulb receiving portion further comprises a lip region sufficient in size to accommodate the bulb portion of a compact fluorescent light and that supports the base of a compact fluorescent light during installation and removal of the light.

* * * * *